US011564456B1

(12) United States Patent
Chang

(10) Patent No.: US 11,564,456 B1
(45) Date of Patent: Jan. 31, 2023

(54) BUCKLE FOR HARNESS

(71) Applicant: JONE SHOU INDUSTRIAL CO., LTD., Nantou County (TW)

(72) Inventor: Chih Shun Chang, Nantou County (TW)

(73) Assignee: JONE SHOU INDUSTRIAL CO., LTD., Nantou County (TW)

( * ) Notice: Subject to any disclaimer, the term of this patent is extended or adjusted under 35 U.S.C. 154(b) by 16 days.

(21) Appl. No.: 17/410,414

(22) Filed: Aug. 24, 2021

(51) Int. Cl.

| | |
|---|---|
| ***B65D 83/62*** | (2006.01) |
| ***A44B 11/24*** | (2006.01) |
| ***B68C 1/14*** | (2006.01) |
| *B65D 83/68* | (2006.01) |

(52) U.S. Cl.
CPC ..... *A44B 11/24* (2013.01); *B68C 1/14* (2013.01)

(58) Field of Classification Search
CPC ..... A44B 11/24; B68C 1/14; B68C 1/142; B68C 2001/142; B68C 2001/145
USPC ..... 24/180, 68 E, 380, 314, 317, 308, 307; 63/14.5, 227; 267/36.1, 263, 154, 155, 267/158, 160
See application file for complete search history.

(56) References Cited

U.S. PATENT DOCUMENTS

| | | | | | |
|---|---|---|---|---|---|
| 682,148 | A * | 9/1901 | MacCarthy | A44B 11/24 | 24/179 |
| 1,881,799 | A * | 10/1932 | Mashek | A44B 11/24 | 24/179 |
| 2,618,826 | A * | 11/1952 | Kirsten | A44B 11/24 | 24/167 |
| 2,816,339 | A * | 12/1957 | Prete, Jr. | A44B 11/14 | 267/155 |
| 5,765,265 | A * | 6/1998 | Kang | A44B 11/24 | 24/177 |
| 5,983,669 | A * | 11/1999 | Karmeli | A44C 27/00 | 267/164 |
| 9,776,851 | B2 * | 10/2017 | Chen | B68C 1/14 | |

* cited by examiner

*Primary Examiner* — Victor D Batson
*Assistant Examiner* — Amber Nicole Helms
(74) *Attorney, Agent, or Firm* — Muncy, Geissler, Olds & Lowe, P.C.

(57) ABSTRACT

A buckle for harness includes a ring member, a bar member and an elastic sheet. The ring member includes two opposite side portions and a cross portion connected with the side portions. A shaft pivotally connected with the side portions is disposed on the bar member for the bar member rotating relative to the ring member. A protruding portion sticks out from the shaft. The elastic sheet includes a fastened end secured to the ring member and a free end firmly abutting against the protruding portion with a rebounding force generated by the elastic sheet. An angle θ defined between the protruding portion and the free end changes as the bar member rotates. The bar member keeps standing if the angle θ is greater than 90 degrees.

6 Claims, 6 Drawing Sheets

BUCKLE FOR HARNESS

BACKGROUND OF THE INVENTION

1. Technical Field

The present invention relates to a harness and more particularly to a buckle used on a harness.

2. Description of Related Art

Horse is an important means of transportation in ancient times. Craftsmen invented saddles and stirrups in order for steadily riding on the horse. Although horse riding has been transformed into a kind of leisure activities for entertainment, equestrian equipment is still continuously improved for the purpose of comfortably riding. A saddle is put on a horse and is secured with straps or belts, which prevents from falling. Particularly, a modern saddle is secured with adjustable straps or belts in order to be properly tied to horses with different body sizes.

A saddle belt disclosed in U.S. Pat. No. 9,776,851 includes a buckle and a belt with several positioning holes. The buckle has a ring and a bar pivotally connected with the ring. The bar is pushed by a spring to normally press upon the belt which penetrates through the ring. Accordingly, it is convenient for the bar to insert into the selected positioning hole.

Because the bar always presses against the belt, the bar automatically slides into the undesired positioning hole when the belt is pulled, and thus the belt is stopped moving. It costs much time to pull the bar out of the positioning hole to continue moving the belt, which causes extreme inconvenience.

BRIEF SUMMARY OF THE INVENTION

The primary objective of the present invention is to provide a buckle for harness whose bar member can be positioned after being pulled out to facilitate the belt to move through the ring member.

To achieve the above objective, the present invention provides a buckle for harness that includes a ring member, a bar member and an elastic sheet. The ring member has two opposite side portions and a cross portion connected with the side portions. The bar member has a shaft provided at a rear end thereof. Each of two ends of the shaft is pivotally connected with the side portions respectively so that the bar member is capable of rotating relative to the ring member. A protruding portion sticks out from a periphery of the shaft. The elastic sheet has a fastened end and a free end. The fastened end is secured to the ring member. The free end firmly abuts against the protruding portion with a rebounding force generated by the elastic sheet. An angle is defined between the protruding portion and the free end. The angle changes as the bar member rotates. The free end pushes the protruding portion to rotate the shaft and thus the bar member is rotated toward the cross portion if the angle is less than 90 degrees. On the other hand, the free end pushes the protruding portion to rotate the shaft and thus the bar member is rotated away from the cross portion if the angle is greater than 90 degrees.

Preferably, the angle is between 30 degrees and 80 degrees when the bar member abuts against the cross portion.

Preferably, a stop portion is disposed between the fastened end and the free end on the elastic sheet to stop the protruding portion rotating continuously so that the bar member is restricted when the angle reaches a terminal angle greater than 90 degrees.

Preferably, each of the side portions includes a first straight section, a second straight section and a third straight section. The first straight section is out of alignment with the third straight section. Each of the first straight section and the third straight section is connected to the second straight section. The cross portion is connected with the third straight section.

Preferably, a rotatable sleeve is provided on the cross portion.

Preferably, each of two longitudinal sides of the elastic sheet which is between the fastened end and the free end is curved inward in an arc-shape.

DETAILED DESCRIPTION OF THE INVENTION

Figure 1:
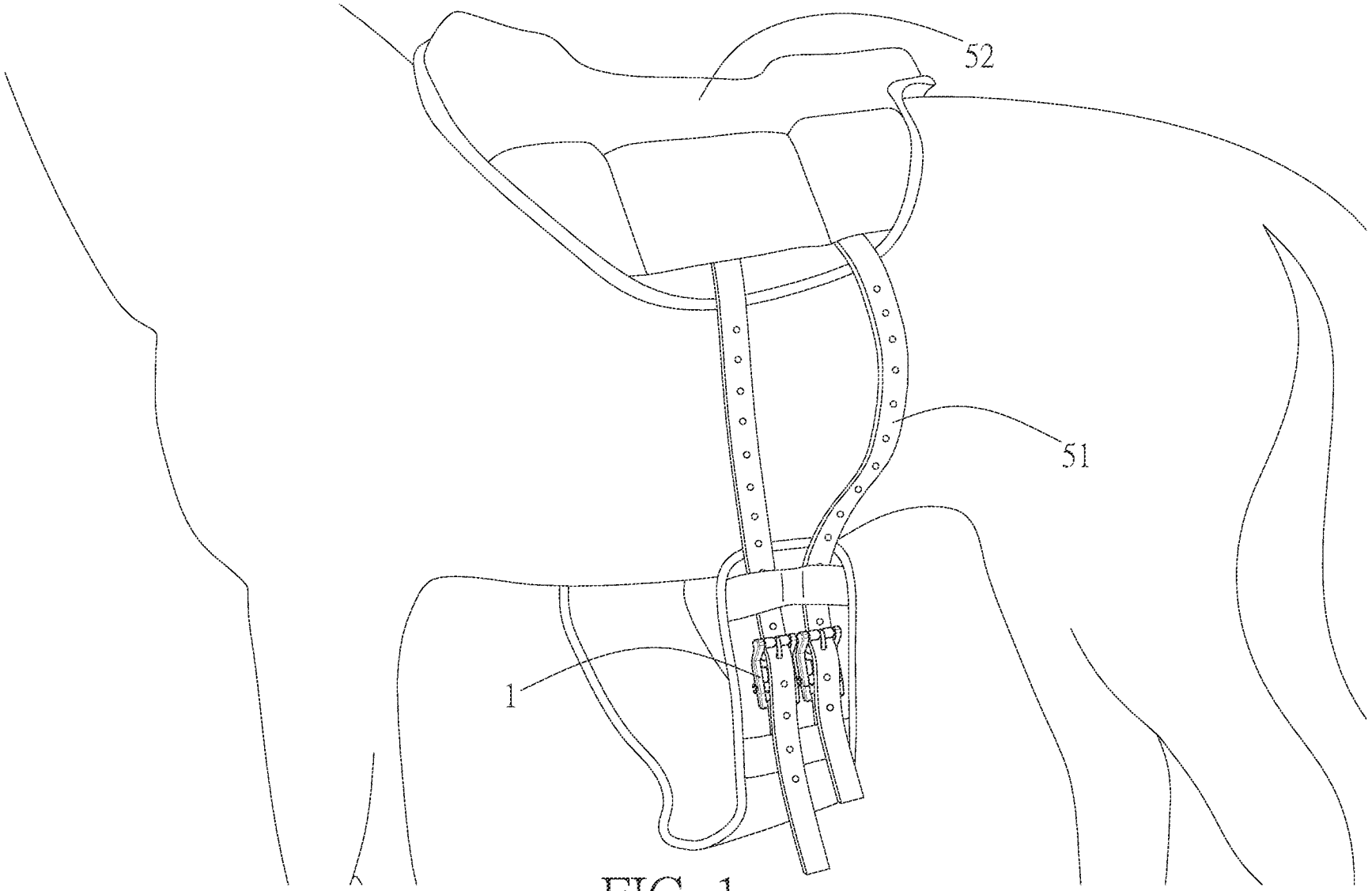
FIG. 1 is a perspective view of the present invention.
Figure 2:
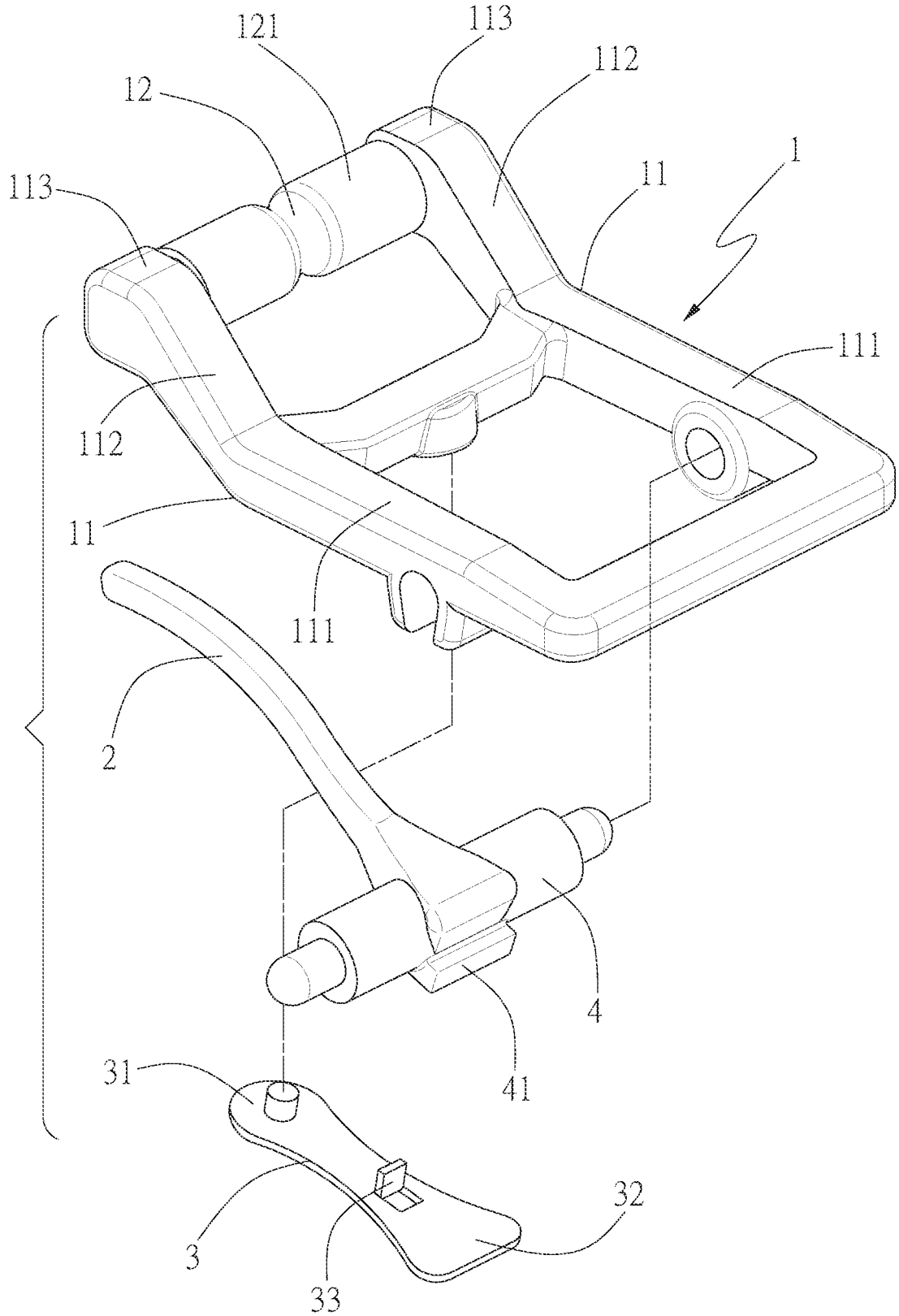
FIG. 2 is an exploded perspective view of the present invention.

Referring to FIG. 1 and FIG. 2, the buckle for harness according to the present invention is matched with the belt 51 to fasten the saddle 52 to a horse. The buckle includes a ring member 1, a bar member 2 and an elastic sheet 3.

The ring member 1 has two long sides and two short sides to form in a rectangular shape. The ring member 1 includes two opposite side portions 11 as the two long sides and a cross portion 12 as one of the short sides. Each of the side portions 11 includes a first straight section 111, a second straight section 112 and a third straight section 113. The first straight section 111 is out of alignment with the third straight section 113. The second straight section 112 connects the first straight section 111 and the third straight section 113. Accordingly, the entire side portion 11 is Z-shaped. Furthermore, the cross portion 12 with a rotatable sleeve 121 is connected with the third straight section 113. There is a height difference between the cross portion 12 and the first straight section 111, so that the belt can be easily inserted into the ring member 1.

The bar member 2 is curved slightly and is provided with a shaft 4 at a rear end thereof. The cross section of the shaft 4 is in an ellipse shape. The shaft 4 extends laterally and both ends of the shaft 4 are pivotally connected to the first straight sections 111, respectively. So the shaft 4 is capable of rotating relative to the ring member 1. A protruding portion 41 sticks out from a periphery of the shaft 4. The shaft 4 can be driven to rotate like a cam when the bar member 2 is pulled, and thus the protruding portion 41 moves accordingly.

The elastic sheet 3 is long and two ends are defined as a fastened end 31 and a free end 32, respectively. The fastened end 31 is riveted on the ring member 1 while the free end 32 is engaged with the protruding portion 41. Each of two longitudinal sides of the elastic sheet which is between the fastened end and the free end is curved inward in an arc-shape.

Figure 3:
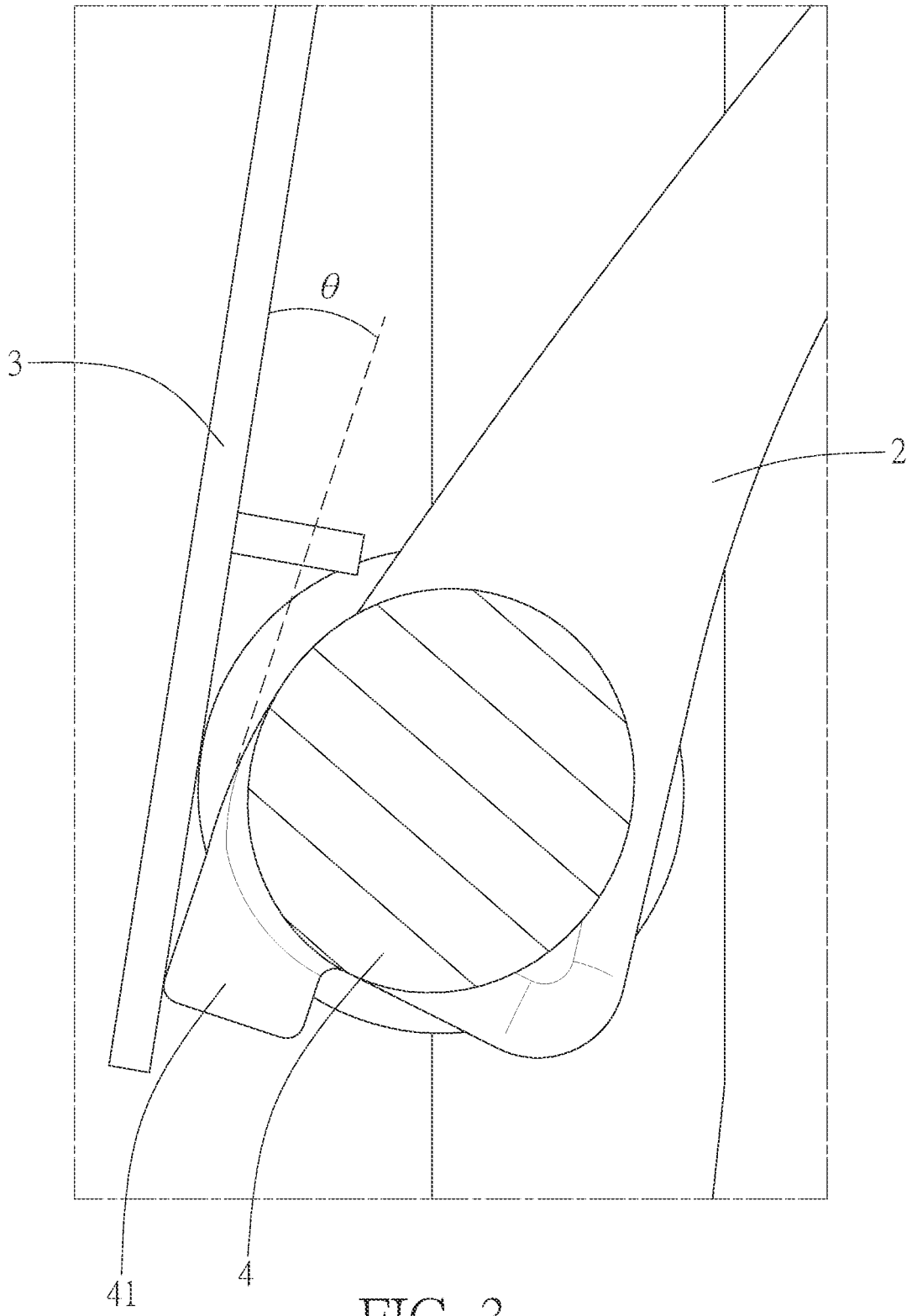
FIG. 3 is a sectional view showing a partial structure of the present invention.

As shown in FIG. 3, an angle θ forms between the protruding portion 41 and the free end 32. The angle θ is between 30 degrees and 80 degrees when the bar member 2 abuts against the cross portion 12. Since the protruding portion 41 sticks out from the shaft 4 and pushes against the free end 32, the elastic sheet 3 is deformed, thereby generating a rebounding force and pressing against the protruding portion 41. This rebounding force will cause a rotational moment to the protruding portion 41 and push the bar member 2 to rotate.

The pivoting direction of the bar member 2 caused by the elastic sheet 3 depends on the value of the angle θ. In one case that the angle θ is less than 90 degrees, the rotational moment which the elastic sheet 3 acts on the protruding portion 41 makes the bar member 2 rotate toward the cross portion 12, and thus the bar member 2 abuts against the cross portion 12 firmly as a result of the rebounding force of the elastic sheet 3. In another case that the angle θ is greater than 90 degrees, the rotational moment which the elastic sheet 3 acts on the protruding portion 41 makes the bar member 2 rotate away from the cross portion 12, and thus the bar member 2 keeps away from the cross portion 12 as a result of the rebounding force of the elastic sheet 3.

Besides, a stop portion 33 is disposed between the fastened end 31 and the free end 32 on the elastic sheet 3 to stop the protruding portion 41 rotating continuously. Thereby the bar member 2 is restricted from rotating when the angle θ reaches a terminal angle greater than 90 degrees.

Figure 4:
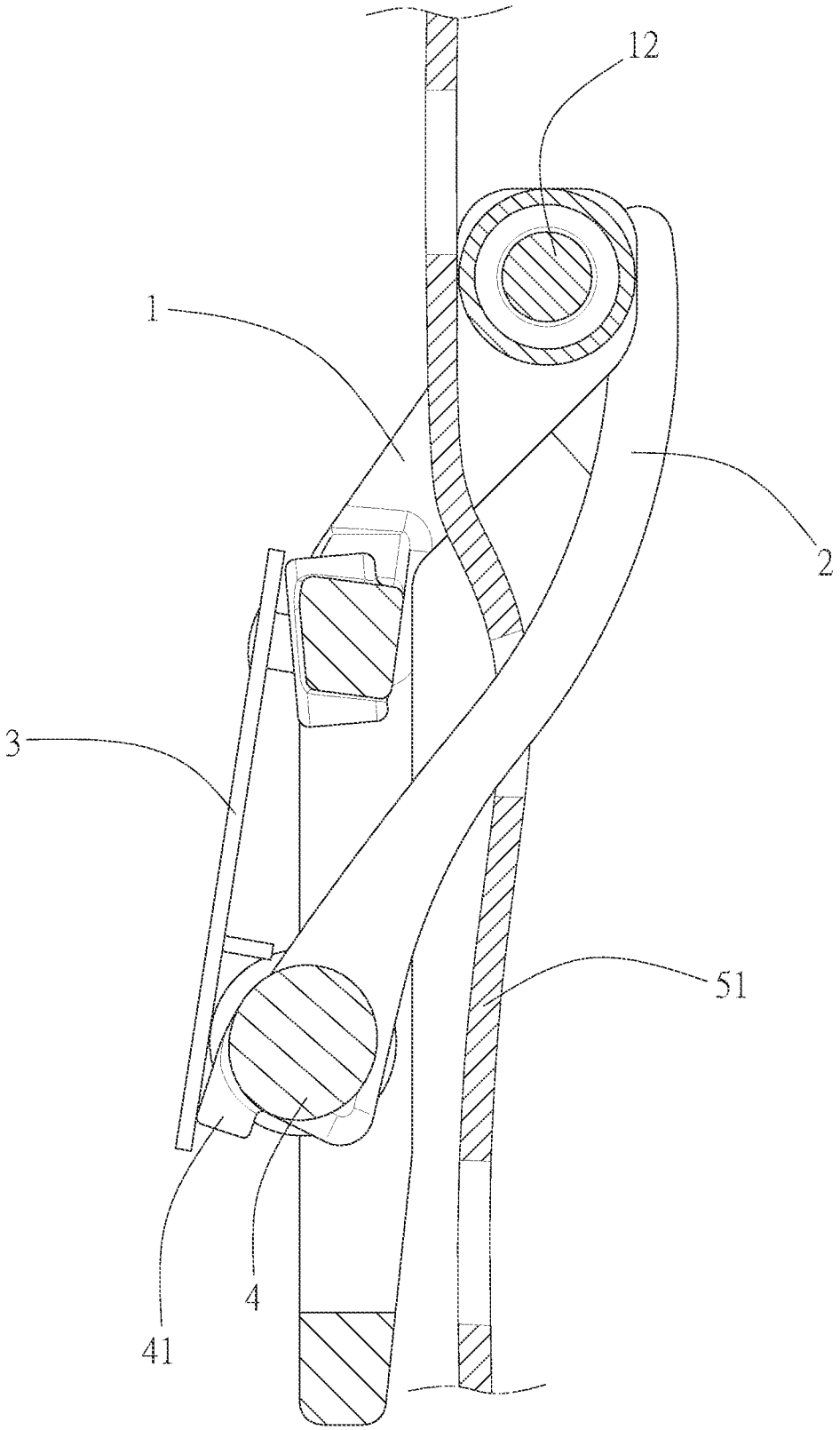
FIG. 4, FIG. 5 and FIG. 6 are sectional views of the present invention when in use.
Figure 5:
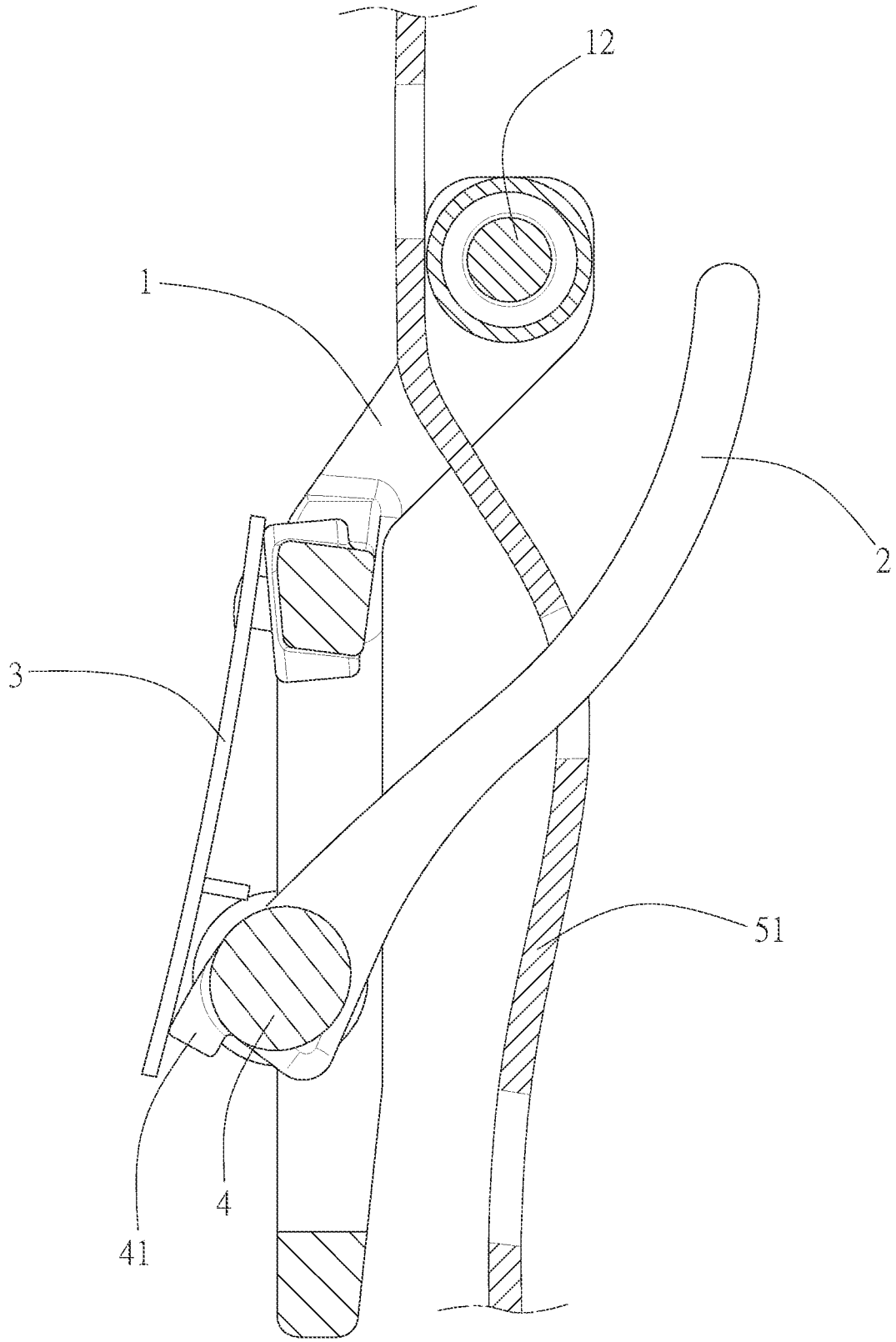
Figure 6:
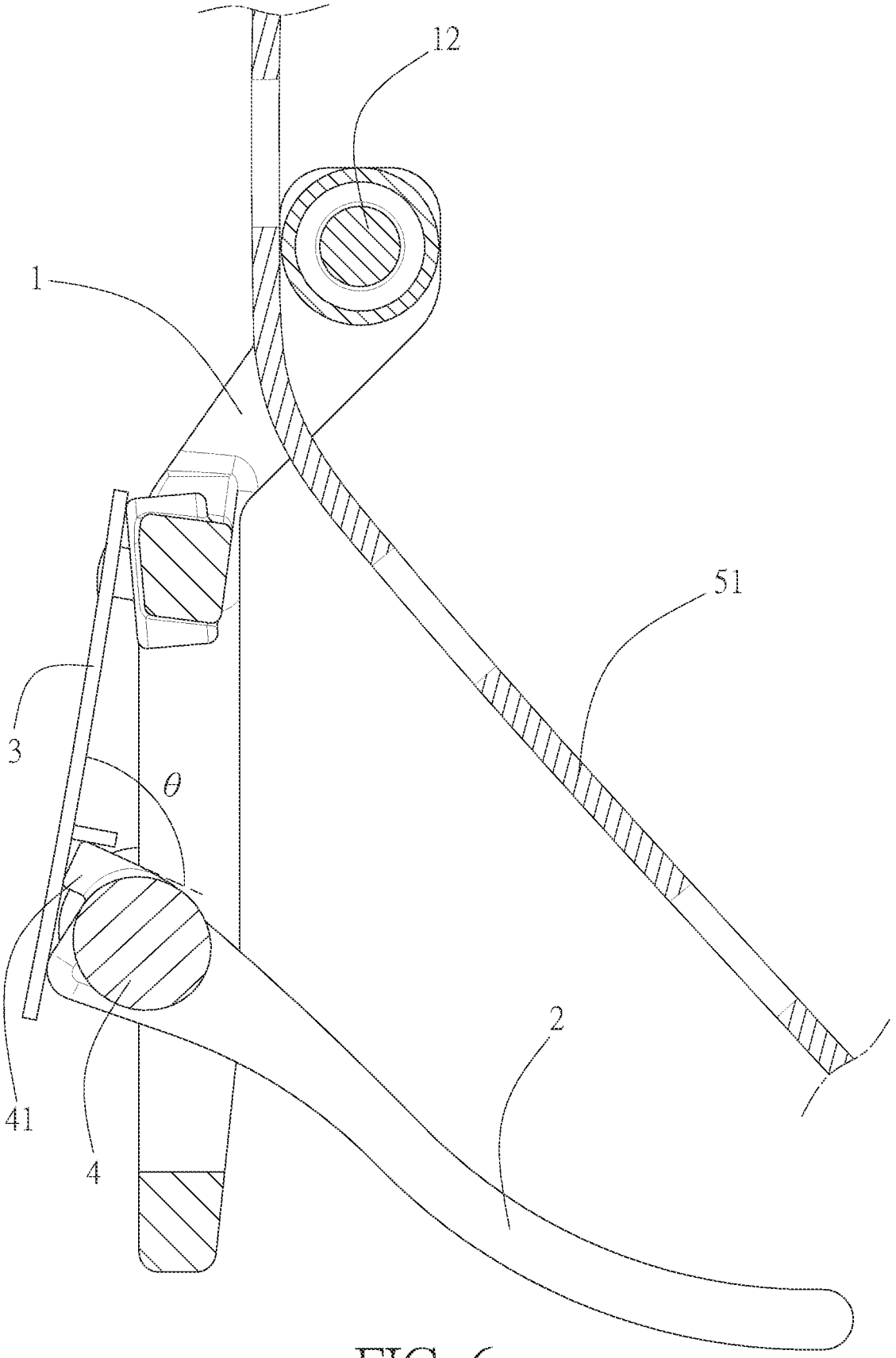

As shown in FIG. 4, the present invention is advantageous in preventing the belt 51 from releasing since the elastic sheet 3 normally presses against the protruding portion 41 to ensure that the bar member 2 abuts against the cross portion 12 firmly when the angle θ is less than 90 degrees. On the other hand, as shown in FIG. 5 and FIG. 6, it is quick and convenient to release the belt 51 with pulling the bar member 2 away from the cross portion 12 for the angle θ greater than 90 degrees so that the bar member 2 keeps standing, or away from the cross portion 12, for the belt 51 being pulled without obstruction.

What is claimed is:

1. A buckle for harness comprising:

a ring member with two opposite side portions and a cross portion connected with the side portions;

a bar member with a shaft provided at a rear end thereof, each of two ends of the shaft being pivotally connected with the side portions respectively so that the bar member is capable of rotating relative to the ring member, the shaft being provided with a protruding portion extending away from a periphery thereof;

an elastic sheet having a fastened end and a free end, the fastened end being secured to the ring member, the free end firmly abutting against the protruding portion with a rebounding force generated by the elastic sheet, wherein an angle defined between the protruding portion and the free end changes as the bar member rotates, wherein the free end pushes the protruding portion to rotate the shaft and thus the bar member is rotated toward the cross portion if the angle is less than 90 degrees, and the free end pushes the protruding portion to rotate the shaft and thus the bar member is rotated away from the cross portion if the angle is greater than 90 degrees.

2. The buckle for harness of claim 1, wherein the angle is between 30 degrees and 80 degrees when the bar member abuts against the cross portion.

3. The buckle for harness of claim 1, wherein a stop portion is disposed between the fastened end and the free end on the elastic sheet to stop the protruding portion rotating continuously so that the bar member is restricted when the angle reaches a terminal angle greater than 90 degrees.

4. The buckle for harness of claim 1, wherein each of the side portions includes a first straight section, a second straight section and a third straight section, the first straight section being out of alignment with the third straight section, each of the first straight section and the third straight section being connected to the second straight section, wherein the cross portion is connected with the third straight section.

5. The buckle for harness of claim 1, wherein a rotatable sleeve is provided on the cross portion.

6. The buckle for harness of claim 1, wherein each of two longitudinal sides of the elastic sheet which is between the fastened end and the free end is curved inward in an arc-shape.

* * * * *